United States Patent [19]

Chen

[11] Patent Number: 4,930,175

[45] Date of Patent: Jun. 5, 1990

[54] WATER-PROOF SNOW BOOT

[75] Inventor: Chin-Lung Chen, No. 30, Thai Yuan Road Sec. 1, West Dist., Taichung, Taiwan

[73] Assignees: Chin-Lung Chen, Taichung, Taiwan; Arthur Joseph Colpack, Boston, Mass.

[21] Appl. No.: 305,979

[22] Filed: Feb. 3, 1989

[51] Int. Cl.[5] ..... A43B 10/00; A43B 1/14; A43B 5/00

[52] U.S. Cl. ..... 12/142 R; 12/142 E; 12/146 C; 36/4; 36/45; 36/83; 36/113

[58] Field of Search ..... 36/116, 113, 4, 117, 36/83, 45, 10; 12/142 R, 142 E, 146 C

[56] References Cited

U.S. PATENT DOCUMENTS

| | | | |
|---|---|---|---|
| 2,619,741 | 12/1952 | Clark | 36/83 X |
| 4,302,889 | 12/1981 | Negrin | 36/4 |
| 4,430,811 | 2/1984 | Okada | 36/45 |

FOREIGN PATENT DOCUMENTS

| | | | |
|---|---|---|---|
| 1041295 | 10/1978 | Canada | 36/4 |
| 2854464 | 7/1980 | Fed. Rep. of Germany | 36/45 |
| 2499374 | 8/1982 | France | 36/83 |
| 2526668 | 11/1983 | France | 36/4 |
| 70430 | 5/1946 | Norway | 36/10 |

*Primary Examiner*—James Kee Chi

[57] ABSTRACT

The present disclosure relates to a water proof snow boot and the method of manufacturing the same. A water-proof plastic intermediate member is disposed between the outer leather covering and the inner lining of the boot to prevent water or moisture from coming into the boot through tiny pores of the leather covering by permeation, thereby causing discomfort of the wearer's foot.

2 Claims, 2 Drawing Sheets

WATER-PROOF SNOW BOOT

BACKGROUND OF THE INVENTION

The present invention is related to an improved boot in which an intermediate member made of water proof plastic material is sandwiched between the outer covering and the inner lining of the boot, so that water or moisture can be prevented from permeating through tiny pores on the covering of either natural or synthetic leather into the boot.

Snow boots are adapted for wearing in snowy weathers for better protection of the wearer's feet against the freezing cold and moist ground covered by snow. General snow boots are made to have only outer leather coverings and inner linings; the outer leather coverings can either be natural or synthetic. No matter what material is used, there are a plurality of tiny pores on the surface of the leather coverings permitting moisture or water to permeate therethrough as long as the boots are exposed to the snowy enviroment for a period of time. The permeated moisture will get the inner linings wet and make the feet rather discomfortable as a result of the dampness of the socks and feet. Moreover, the feet can be affected because of long-term exposure to dampness.

The present inventor noticed the disadvantages inherent with prior art snow boots and worked in effort to make improvement thereon and also disclosed a method of manufacturing the same.

SUMMARY OF THE INVENTION

Therefore, the primary object of the present invention is to provide an improved water proof snow boot and method of manufacturing the same. The present boot is equipped with an intermediate member made of water proof plastic material and disposed externally of the inner lining of the boot; i.e., the intermediate member is disposed between the outer leather covering and the inner lining so that water can be stopped from permeating into the boot.

One further object of the present invention is to provide a method of manufacturing the water proof snow boot which includes the following steps of: integrating a preshaped water proof intermediate member of plastic material to a correspondingly formed inner lining coated with an adhesive substance over part of the external surface thereof so that the two can be bound firmly together; turning the outer leather covering inside out, which consists of a heel portion and foot covering on all of which are provided with thermo adhesive material; stitching the rim of the opening of the boot to the rim of the integrated intermediate member, then overturning the leather covering all the way to cover the intermediate member and sticking a midsole to the bottom of the properly folded leather covering, then sticking further an outer sole to the bottom of the midsole to complete the water proof snow boot.

To better illustrate the structure and operational steps of manufacturing the present snow boot, a number of drawings are given in company with a detailed description of the preferred embodiment, in which:

BRIEF DESCRIPTION OF THE DRAWINGS

FIG. 1A is an enlarged diagram showing the structure of the rim of the opening of the boot, circled and indicated by "A" in FIG. 1;

DETAILED DESCRIPTION OF PREFERRED EMBODIMENT

Figure 1:
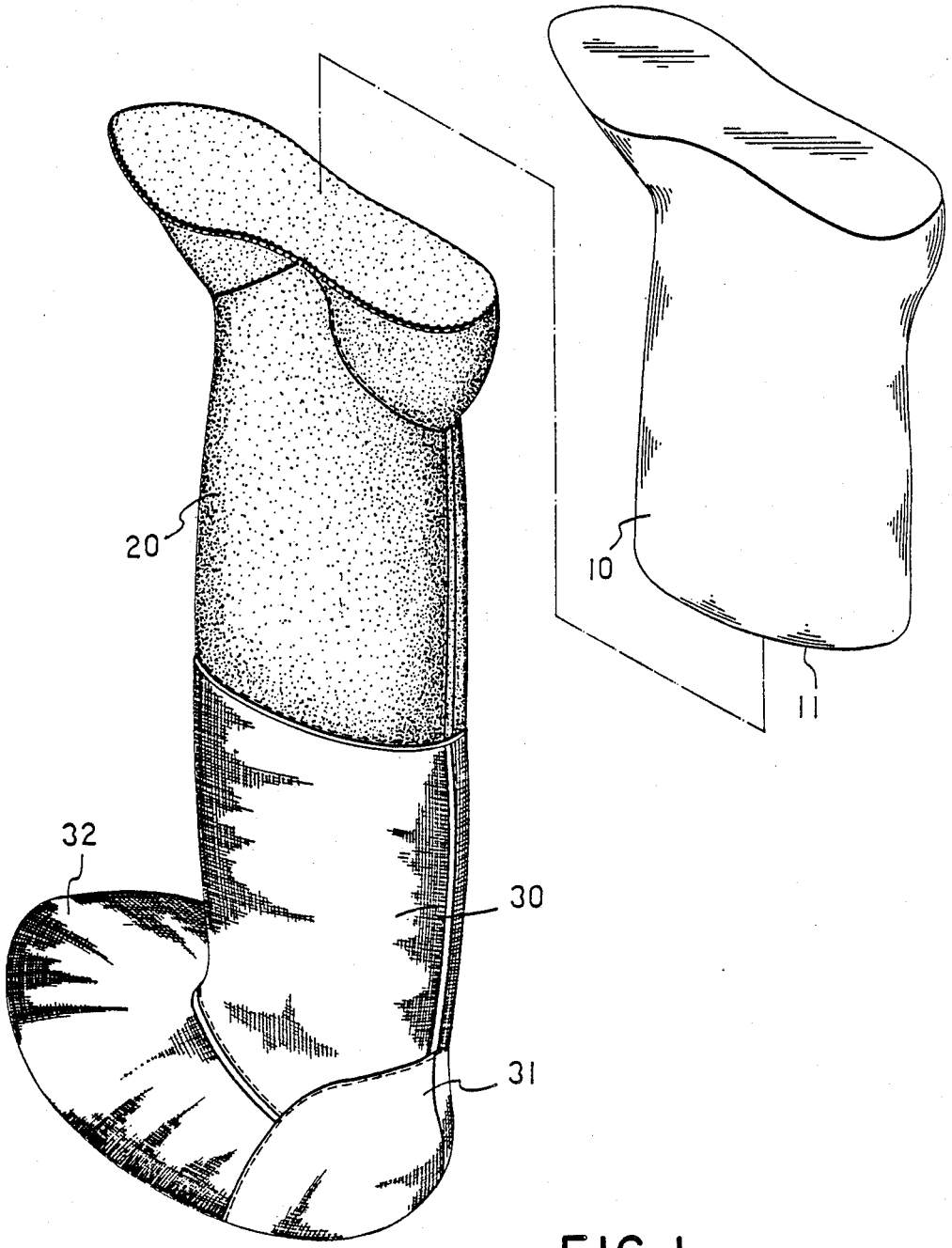
FIG. 1 is a diagram showing the step of overturning the inside out leather covering to cover the external surface of the intermediate member.

Referring to FIG. 1, the present water proof snow boot comprises a water proof plastic intermediate member 10, an inner lining 20, a leather covering 30 having an attached heel member 31 a midsole 40 and an outer sole 50.

Figure 2:
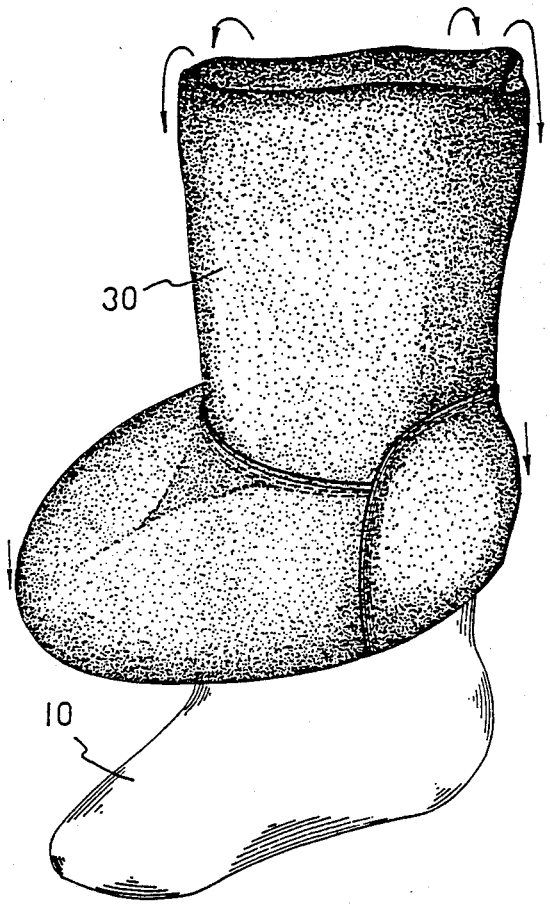
FIG. 2 is a diagram showing the structure of a boot-like water proof plastic intermediate member.

The structure and the manufacturing steps of the present invention are given as follows:

1. The intermediate member 10 is conventionally formed by way of a mold with melted plastic material coated all over the inner surface thereof, then the member is blown dry and cooled for shape forming and removed out of the mold with the member shaped in a boot form as shown in FIG. 2. This step is not included in the claims of the present invention.

Figure 3:
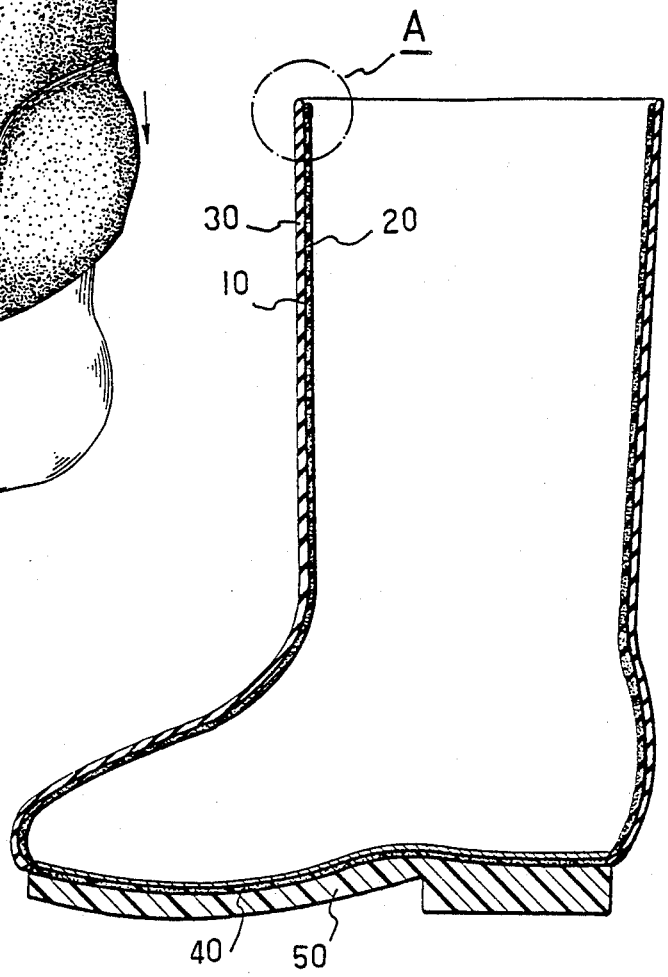
FIG. 3 is a diagram showing the manufacturing step of stitching the rims of the intermediate member and the leather covering together with the latter turned inside out.

2. Stitching a number of pre-cut pieces of soft lining material and leather separately together to form respectively the boot-shaped inner lining 20 and a bottom-opened outer leather covering 30, and coating the outer surface of the inner lining at the foot portion thereof with a thermo-adhesive substance, then seaming the rims of the top openings of the inner lining 20 and outer leather covering 30 together as shown in FIG. 3.

3. Covering the inner side of the outer leather covering 30 with thermo-adhesive strips 32 and adhering with glue a heel member 31 to the heel portion of the leather covering, for facilitating shape forming and strengthening the assembly.

4. Joining the water-proof intermediate member 10 and the inner lining 20 together by placing the former on top of the correspondingly shaped latter, then adhering the rims of the openings of the intermediate member 10 and the inner lining 20 together by glue to prevent the inner lining 20 from collapsing.

5. Placing a foot-shaped shoetree into the inner lining 20 and adding heat to activate the thermo-adhesive substance to permit the intermediate member 10 and the inner lining 20 to bind firmly together.

Figure 4:
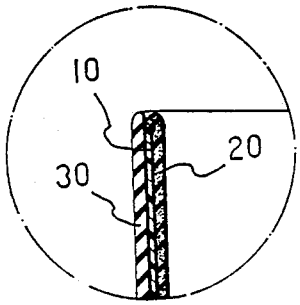
FIG. 4 is a diagram showing a sectional view of the present water proof snow boot.

6. Overturning the inside-out leather covering to cover the intermediate member 10, then heating the leather covering 30 to make the thermo-adhesive strips 31 work for firmly binding the two together, as shown in FIG. 4; then adhering the midsole 40 to the bottom of the intermediate member 10, and attaching the periphery of the opened bottom of the leather covering 30 to the underside of the midsole 40 by glue, afterwards fixing the outersole 50 to the underside of the midsole 40 by adhesive substance to obtain a water proof snow boot of the present invention.

It has been clearly disclosed that the present snow boot is able to effect water proof purpose by sandwiching the intermediate member 10 made of water proof plastics between the leather covering 30 and the inner lining 20 so that moisture or water can not permeate into the boot through a plurality of tiny pores of the outer leather covering 30. Thus, the inner lining 20 can be kept dry all the time. Moreover, the foot in the boot can still have little space to move so that air circulation will be available. Besides, cold weather makes the problem of boot perspiration less serious so that the inside of the boot can be kept comfortably dry.

I claim:

1. An improved process of manufacturing a water proof snow boot comprising:

inserting an inner lining into a water proof plastic intermediate member with a shoetree; binding rims of openings of said lining and intermediate member together by an adhesive material;

putting a shoetree into said inner lining and adding heat from outside of said intermediate member to firmly bind them together;

seaming the rim of a top opening of an outer leather covering with the rim of the opening of said inner lining with the inside of the outer leather covering turned out and disposed in head to head connection with said inner lining;

attaching an inner surface of said outer leather covering which covers a back of a foot with thermo-adhesive strips and fixing a hell member with glue to an inner heel portion;

overturning said inside-out leather covering to cover all surfaces of said intermediate member;

heating the surface of said leather covering to melt said thermo-adhesive strips thereon so that said outer leather covering and said intermediate member is firmly joined together;

attaching a midsole to a bottom of said intermediate member with glue;

adhering an open-bottomed periphery of the leather covering to the midsole underside; and attaching an outer sole to a bottom of said midsole to complete production of the snow boot.

2. An improved water proof snow boot prepared by the process of claim 1.

* * * * *